United States Patent [19]

Boswell

[11] 4,295,290

[45] Oct. 20, 1981

[54] TOY PROJECTILE

[75] Inventor: George T. Boswell, Springfield, Va.

[73] Assignee: Frontier Industries, Inc., Springfield, Va.

[21] Appl. No.: 164,909

[22] Filed: Jul. 1, 1980

[51] Int. Cl.[3] ..... A63H 27/00

[52] U.S. Cl. ..... 46/74 C

[58] Field of Search ..... 46/74 C, 74 B, 74 A, 46/74 R, 75, 82; 273/428; 102/92.1, 92.2, 92.3, 92.4, 92.6, 92.7; 244/3.24, 3.27, 3.3

[56] References Cited

U.S. PATENT DOCUMENTS

| | | | |
|---|---|---|---|
| 2,380,278 | 7/1945 | Weissman | 46/75 UX |
| 3,188,768 | 6/1965 | Boswell | 46/75 |
| 3,327,967 | 6/1967 | Schrantz | 46/74 R X |
| 3,952,662 | 4/1976 | Greeniees | 102/92.7 |

FOREIGN PATENT DOCUMENTS

| | | | |
|---|---|---|---|
| 76816 | 10/1961 | France | 46/74 C |
| 320577 | 8/1934 | Italy | 46/75 |

*Primary Examiner*—Robert Peshock
*Assistant Examiner*—Mickey Yu
*Attorney, Agent, or Firm*—Jacobi, Lilling, Siegel & Presta

[57] ABSTRACT

A toy projectile comprising an upper stage having a segmented, tubular rocket-simulating body in which segments or vanes are hinged and formed to provide a rocket vehicle-like configuration in the closed condition and, upon opening, provide radially disposed air foil members which operate in the manner of an autogyro or helicopter to provide gyro rotation of the vehicle for slow descent after it has reached its apogee. The lower stage comprises a tube which is slidably and frictionally receivable within a lower adaptor portion on the upper stage so as to removably mount the lower stage on the upper stage. A solid grain propellant engine, including a thrust charge, delay and separation charge, is mounted in the tube of the lower stage. The lower stage serves to retain the segments or vanes in a closed condition before separation of the upper and lower stages by the separation charge within the lower stage.

10 Claims, 6 Drawing Figures

FIG. 1
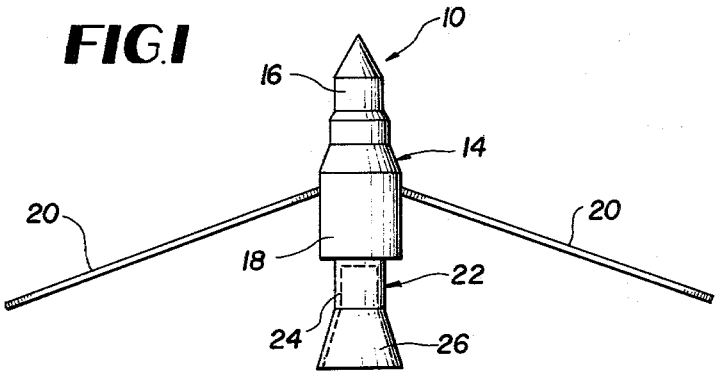
FIG. 2
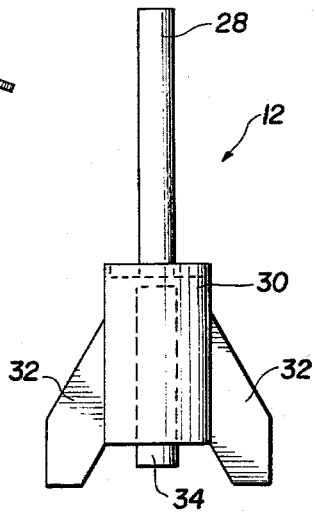
FIG. 3
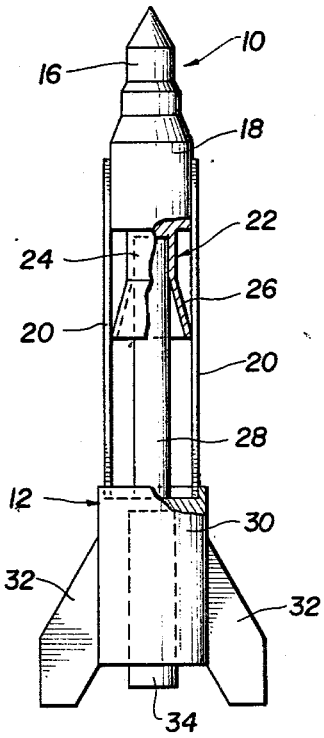
FIG. 4
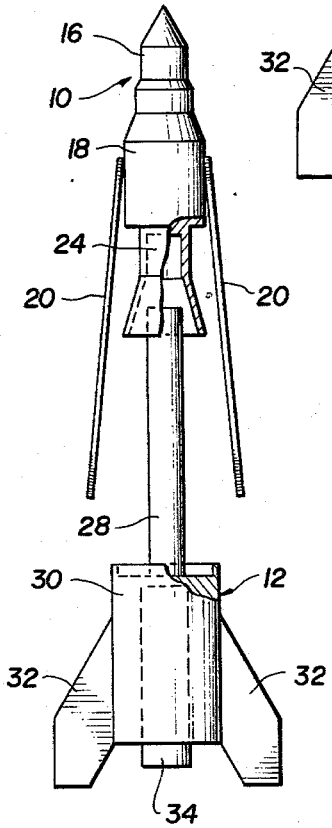
FIG. 5
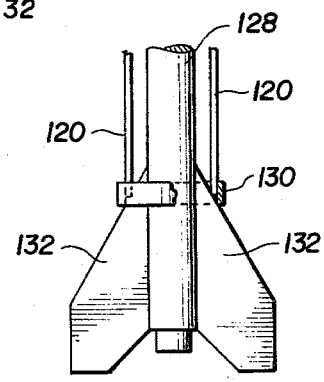
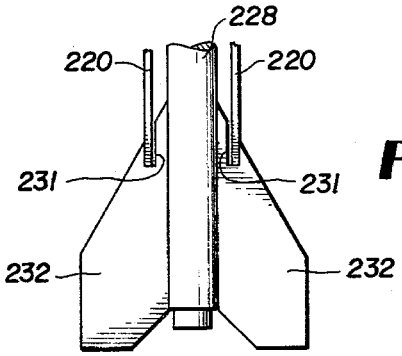
FIG. 6

TOY PROJECTILE

BACKGROUND OF THE INVENTION

This invention relates in general to a toy projectile and in particular to a rocket-simulating toy projectile which automatically converts to a space platform-type vehicle during flight and which can be launched by a solid grain propellant engine including a thrust charge, delay and separation charge.

With the increased interest now being shown in rocketry and space flights generated largely by the activities of N.A.S.A. in the United States and Russian scientific achievements in satellite launchings and interplanetary flights, there is an increasing amount of interest in toy projectiles which simulate rockets, space vehicles, satellites and space platforms.

There presently exist many toy projectiles which, through various means, are actuated to convert or separate during midflight to produce parachutes, gliders and similar separated units. One toy of this kind is an elastic-launched, rocket-simulating device which opens in mid-air to produce a gyro-rotating type of winged vehicle which, after separation from the rocket simulating vehicle, rotates to produce a slow descent to earth.

It has been found that interest and attraction in a toy vehicle of the type described is a function of the time of flight or activity of that projectile. In other words, the longer a toy of this type can be made to remain airborne, the greater the interest afforded by the toy. Time of flight, especially in an auto-rotative type toy, depends on the weight of the vehicle and the area of air foil presented as a lifting surface. The larger the ratio of area of air foil to weight, generally the longer the time of flight realized in the vehicle. Many of the prior art devices utilize either separate auto-rotative devices ejected from an air frame or air foils which extend from a conventional air frame. In both cases, there is a large amount of wasted weight; in the former, the air frame itself falls to the ground without any flight, and in the latter case, the weight of the air frame, as a non-lifting entity, shortens the time of flight of the vehicle.

SUMMARY OF THE INVENTON

It is an object of this invention to provide a toy auto-rotative missile in which a very high lifting surface to weight ratio is achieved.

It is another object of this invention to provide a toy auto-rotative projectile in which the projectile air frame itself is utilized as the air foil structure for the auto-rotative portion of the flight.

Another object is to provide a simple but effective means for converting the projectile air frame into the air foil structure at the most opportune moment of flight and with good reliability of performance.

It is still another object of this invention to provide a rocket simulating toy projectile which converts to a gyro rotating descent vehicle.

It is a further object of this invention to provide a rocket simulating projectile which, by utilizing the structure of the vehicle itself, provides a unitary rocket ascent and gyro-rotating descent device.

It is another object of this invention to provide a simple, inexpensive and reliable mechanism to provide midflight conversion of a rocket simulating device to a gyro-rotating descent vehicle.

It is still a further object of this invention to provide a safe and simple toy projectile which provides a high degree of interest with a minimum of expenditure of material and effort.

It is still another object of this invention to provide a projectile-actuating mechanism suitable for use with a solid grain propellant engine, such as that used for model rockets, which includes a thrust charge, delay and separation charge.

These objects are accomplished by the present invention by forming a projectile that consists primarily of a segmented, tubular rocket-simulating body in which the vanes or segments are hinged and formed to provide a rocket vehicle-like configuration in the closed condition and, upon opening, provide radially disposed air foil members which operate in the manner of an autogyro or helicopter to provide gyro rotation of the vehicle for slow descent after the projectile has reached its apogee. The segmented members making up the major portion of the rocket body are biased in such a manner as to cause the segments to be deployed as a blade wheel under static conditions, but may be easily folded and held in a folded condition during and after launching.

In U.S. Pat. No. 3,188,768, the teachings of which are incorporated herein by reference, launching of the projectile may be accomplished through the use of a slingshot hand launcher or a $CO_2$ cartridge. The projectile of the present application represents a modification of the projectile disclosed in U.S. Pat. No. 3,188,768, the present projectile being modified so that it can be launched by a solid propellant engine or the like, which includes a thrust charge, delay and separation charge.

The toy projectile of the present invention comprises an upper stage having a segmented, tubular rocket-simulating body in which the vanes or segments are hinged and formed to provide a rocket vehicle-like configuration in the closed condition and, upon opening, provide radially disposed air foil members which operate in the manner of an autogyro or helicopter to provide gyro rotation of the vehicle for slow descent after it has reached its apogee. The lower stage comprises a tube which is slidably and frictionally receivable within a lower adaptor on the first stage so as to removably secure the lower stage to the upper stage. A solid propellant engine, including a thrust charge, delay and separation charge, is mounted in the tube of the lower stage. The lower stage comprises means for retaining the segments or vanes in a closed condition before separation of the upper and lower stages by the separation charge within the lower stage.

In operation, the projectile is launched in an upward direction by the thrust charge mounted on the lower stage secured to the upper stage. The retaining means of the lower stage serves to retain the segments or vanes in a closed position so that the projectile retains the configuration of a rocket-type missile. As the projectile decelerates under the influence of gravity and approaches the apogee of its flight, the separation charge in the lower stage serves to effect separation of the upper and lower stages which causes the lower ends of the vanes to move past the retaining means on the lower stage so that the vanes are pivotally deployed outwardly by suitable biasing means to a radially disposed position. At this point, the upper stage begins a descent towards earth and aerodynamic forces acting on the deployed vanes or segments induce rotation of the projectile. This rotation induces local flow over each of the individual vanes or air foils and, through principles well known in the art, imposes lift on these foils resulting in a slow rotary descent of the upper stage to earth.

BRIEF DESCRIPTION OF THE DRAWINGS

FIG. 1 is a side elevational view of the upper stage of a toy projectile constructed in accordance with the principles of the present invention, showing the vanes in the radially outwardly disposed, open position;

FIG. 2 is a side elevational view of the lower stage of the toy projectile of the present invention;

FIG. 3 is a side elevational view, with parts broken away, of the toy projectile of the present invention, showing the upper and lower stages in an assembled, launch position;

FIG. 4 is a side elevational view similar to FIG. 3, showing the upper stage partially separated from the lower stage with the vanes of the upper stage moving from a closed to an open position;

FIG. 5 is a side elevational view, with parts broken away, showing a modified form of the lower stage of the toy projectile of the present invention; and FIG. 6 is a side elevational view of a further embodiment of the lower stage of the toy projectile of the present invention.

DESCRIPTION OF THE PREFERRED EMBODIMENTS

As shown in FIGS. 1–4, the toy projectile of the present invention comprises an upper stage 10 (FIG. 1) and a lower stage 12 (FIG. 2). The upper stage 10 generally comprises a nose member 14 having a nose cone 16 and a base 18. A plurality of vanes 20 are pivotally mounted on or within the base 18 in any suitable manner and are movable between the open position shown in FIG. 1 and the closed position shown in FIG. 3. The vanes 20 are constructed as air foil members as further described in U.S. Pat. No. 3,188,768. Any suitable means, such as a spring (not shown), may be provided to bias the vanes 20 to the open position shown in FIG. 1. Essentially, the portion of the upper phase 10 described herein to this point may be substantially identical with the projectile shown in FIG. 8 of U.S. Pat. No. 3,188,768 and described therein, with the exception that an adaptor portion 22 is secured to the base 18 of the upper stage 10 in place of the cup 62, capsule 64 and spring piston 66 shown in FIG. 8 of the subject patent. The adaptor portion 22 preferably is formed with an upper cylindrical section 24 and a lower frusto-conical section 26. Within the scope of the present invention, the adaptor portion 22 may also be formed of a cylindrical shape throughout its entire length.

The second stage 12 shown in FIG. 2 generally comprises a first tubular portion 28, a second tubular portion 30 secured to and surrounding the lower end of the first tubular portion 28, a plurality of stabilizing fins 32 secured to the second tubular portion 30, and propulsion means such as a solid propellant rocket engine 34 mounted within the lower end of the first tubular portion 28 in any suitable manner, such as by internal ribs or rings (not shown). The engine 34 may be any suitable type of known solid propellant rocket engine or other propulsion means including a thrust charge, delay and separation charge.

The outer diameter of the first tubular portion 28 of the lower stage 12 is substantially equal to the internal diameter of the cylindrical section 24 of the adaptor portion 22 of the first stage 10 so that the tubular portion 28 may be slidably received within the cylindrical section 24 and frictionally retained therein to removably secure the lower stage 12 to the upper stage 10 before and during launching of the projectile. The frustoconical section 26 of the adaptor portion 22 facilitates the entry of the tubular portion 28 into the cylindrical section 24. FIG. 3 of the drawings shows the lower stage 12 removably secured to the upper stage 10 with the tubular portion 28 inserted within the adaptor portion 22 and the lower ends of the vanes 20 disposed within the second tubular portion 30 for the purpose of retaining the vanes in the closed position against the force of the biasing means or spring. This is the launch configuration for the projectile of the present invention.

In the operation of the projectile, the engine 34 is ignited to activate the thrust charge and to launch the projectile upwardly. In accordance with known principles, after the thrust charge has burned, there is a delay before ignition of the separation charge of the engine 34 so as to allow the projectile to move upwardly toward its apogee before effecting separation of the upper and lower stages. The subsequent ignition and burning of the separation charge causes a pressure buildup within the tubular portion 28 of the lower stage and against the base 18 of the upper stage 10 to cause the tubular portion 28 to move downwardly out of the cylindrical section 24 of the adaptor portion 22 to separate the lower stage from the upper stage. During this downward movement of the lower stage 12, the second tubular portion 30 moves beyond the lower ends of the vanes 20, which allows the biasing means to move the vanes toward the open position, as shown in FIG. 4.

Upon complete separation of the upper and lower stages, and movement of the vanes 20 to the fully open position shown in FIG. 1, the upper stage 10 of the projectile will slowly descend in the manner of an autogyro or helicopter because of the radially disposed vanes or air foil members 20 as more specifically described in the referenced U.S. Pat. No. 3,188,768.

FIGS. 5 and 6 illustrate alternate means for retaining the vanes 20 in a closed position before and during launching of the projectile. In FIG. 5, the vanes 120 are retained in the closed position by a ring 130 secured to and surrounding the first tubular portion 128, and the fins 132 are secured to the first tubular portion 28.

In FIG. 6, the fins 232 are secured to the tubular portion 228 and the lower ends of the vanes 220 are received within upwardly opening slots 231 in the fins 232 to retain the vanes in the closed position before separation of the upper and lower stages.

In accordance with the principles of the present invention, the vanes may be biased to the open position by any suitable means, and any suitable means may be utilized to retain the vanes in the closed position against the force of the biasing means when the upper and lower stages are assembled together. Also, any suitable propulsion means could be utilized other than a solid propellant engine, assuming that such propulsion means would be practical and safe for use with the toy or model projectile of the present invention.

It is also noted that the components of the upper and lower stages of the projectile of the present invention may be formed of any suitable materials, such as wood, plastic, metal or the like.

What is claimed is:

1. A toy projectile having an upper stage and a lower stage, said upper stage comprising a plurality of vanes movably mounted thereon for movement between a closed, substantially longitudinally extending position and an open, substantially radially outwardly extending position, means for biasing said vanes to said open position, and an adaptor portion disposed on the lower end of said upper stage and comprising a downwardly opening tubular section; and said lower stage comprising a first tubular portion having an upper end adapted to be received within said tubular section of said adaptor portion to removably secure said lower stage to said upper stage, means mounted on said first tubular portion for engaging the lower portions of said vanes to retain them in said closed position when said upper and lower stages are removably connected, and means mounted in the lower end of said first tubular portion for propelling said projectile and for separating said upper and lower stages to enable the lower portions of said vanes to move away from said retaining means, whereby said biasing means moves said vanes to said open position.

2. The toy projectile of claim 1 wherein said adaptor portion comprises an upper substantially cylindrical section and a lower substantially frusto-conical section, and wherein the upper end of said first tubular portion is slidably receivable within said upper cylindrical section to frictionally retain said lower stage on said upper stage.

3. The toy projectile of claim 1 wherein said means to retain said vanes in said closed position comprises a second tubular portion secured to and surrounding the lower end of said first tubular portion, the lower ends of said vanes being receivable within said second tubular portion when said upper and lower stages are removably connected to retain said vanes in said closed position.

4. The toy projectile of claim 1 wherein said means to retain said vanes in said closed position comprises a ring secured to and surrounding the lower end of said first tubular portion, the lower ends of said vanes being receivable within said ring when said upper and lower stages are removably connected to retain said vanes in said closed position.

5. The toy projectile of claim 1 wherein said means to retain said vanes in said closed position comprises a plurality of fins secured to the lower end of said first tubular portion, said fins having upwardly opening slots positioned to receive the lower ends of said vanes therein when said upper and lower stages are removably connected.

6. The toy projectile of claim 1 wherein a plurality of stabilizing fins are connected to the lower end of said first tubular portion.

7. The toy projectile of claim 1 wherein said propulsion means comprises a solid propellant engine.

8. The toy projectile of claim 7 wherein said engine comprises a thrust charge, delay means, and a charge for separating said upper and lower stages.

9. The toy projectile of claim 1 wherein said vanes are substantially symmetrically disposed around said upper stage.

10. The toy projectile of claim 1 wherein said upper stage further comprises a base and a nose cone secured to the upper end of said base, said adaptor portion being secured to the lower end of said base.

* * * * *